US012643736B2

(12) United States Patent
Schreiner et al.

(10) Patent No.: US 12,643,736 B2
(45) Date of Patent: Jun. 2, 2026

(54) STORAGE CONTAINER LID ASSEMBLY AND RELATED METHODS AND SYSTEMS

(71) Applicant: The GSI Group, LLC, Assumption, IL (US)

(72) Inventors: Garrett Schreiner, Assumption, IL (US); Raymond Fox, Assumption, IL (US); Thomas D. Fleshner, Shelbyville, IL (US)

(73) Assignee: The GSI Group, LLC, Assumption, IL (US)

( * ) Notice: Subject to any disclaimer, the term of this patent is extended or adjusted under 35 U.S.C. 154(b) by 74 days.

(21) Appl. No.: 18/600,389

(22) Filed: Mar. 8, 2024

(65) Prior Publication Data

US 2024/0359906 A1 Oct. 31, 2024

Related U.S. Application Data

(60) Provisional application No. 63/499,163, filed on Apr. 28, 2023.

(51) Int. Cl.

| | |
|---|---|
| ***B65D 90/58*** | (2006.01) |
| ***B65D 88/08*** | (2006.01) |
| *A01F 25/14* | (2006.01) |

(52) U.S. Cl.

CPC ..... *B65D 90/582* (2013.01); *B65D 88/08* (2013.01)

(58) Field of Classification Search

CPC ..... A01F 25/14; B65D 1/0223; B65D 11/12; B65D 11/1846; B65D 15/22; B65D 19/06;

(Continued)

(56) References Cited

U.S. PATENT DOCUMENTS 2,227,712 A * 1/1941 Hackley ..... E04F 21/12 105/282.2
3,386,206 A * 6/1968 Walter ..... F16J 13/02 49/221

(Continued)

FOREIGN PATENT DOCUMENTS

AU 2004216662 A1 * 4/2005 ..... E05F 15/643
CN 211037494 U 7/2020

(Continued)

OTHER PUBLICATIONS

UK Intellectual Property Office, Search report for related UK Application No. GB2307125.1, dated Sep. 14, 2023, 5 pages.

*Primary Examiner* — Anthony D Stashick
*Assistant Examiner* — Marcos Javier Rodriguez Molina
(74) *Attorney, Agent, or Firm* — RAY QUINNEY & NEBEKER; Daniel J. Bezdjian

(57) ABSTRACT

A storage container system includes a storage container having a frustoconical roof defining a central opening and a lid assembly mounted to the roof of the storage container. The lid assembly includes a rail guide member mounted to the roof of the storage container and oriented such that a center longitudinal axis of the rail guide member has a same pitch as the roof and a lid rotatably coupled to the rail guide member and configured to slide along the rail guide member between open and closed positions over the opening, where when the lid is in an open position, an upper surface of the lid has a same pitch as the roof.

20 Claims, 6 Drawing Sheets

(58) Field of Classification Search
CPC ..... B65D 19/08; B65D 19/38; B65D 19/42; B65D 19/44; B65D 21/0204; B65D 21/08; B65D 21/086; B65D 2203/02; B65D 2203/10; B65D 2205/02; B65D 2215/02; B65D 2215/06; B65D 2251/0015; B65D 2251/1058; B65D 2251/20; B65D 23/00; B65D 25/00; B65D 25/005; B65D 25/02; B65D 25/04; B65D 25/06; B65D 25/10; B65D 25/101; B65D 25/102; B65D 25/108; B65D 25/20; B65D 25/22; B65D 25/24; B65D 25/28; B65D 25/2826; B65D 25/34; B65D 25/38; B65D 25/52; B65D 25/54; B65D 2519/00019; B65D 2519/00024; B65D 2519/00029; B65D 2519/00034; B65D 2519/00044; B65D 2519/00059; B65D 2519/00069; B65D 2519/00094; B65D 2519/00159; B65D 2519/00164; B65D 2519/00174; B65D 2519/00194; B65D 2519/00208; B65D 2519/00233; B65D 2519/00268; B65D 2519/00273; B65D 2519/00288; B65D 2519/00293; B65D 2519/00318; B65D 2519/00323; B65D 2519/00333; B65D 2519/00338; B65D 2519/00373; B65D 2519/00497; B65D 2519/00502; B65D 2519/00562; B65D 2519/00626; B65D 2519/00641; B65D 2519/00666; B65D 2519/00701; B65D 2519/00711; B65D 2519/00781; B65D 2519/00805; B65D 2519/0082; B65D 2519/0086; B65D 2519/0097; B65D 2519/0099; B65D 2543/00046; B65D 2543/00092; B65D 2543/00194; B65D 2543/00296; B65D 2543/0049; B65D 2543/00537; B65D 2543/00546; B65D 2543/00555; B65D 2543/00685; B65D 2543/00796; B65D 2571/00055; B65D 2585/6882; B65D 2585/86; B65D 33/04; B65D 33/14; B65D 33/16; B65D 33/2508; B65D 33/2516; B65D 33/2541; B65D 35/02; B65D 41/04; B65D 43/02; B65D 43/0204; B65D 43/0212; B65D 43/0225; B65D 43/12; B65D 43/16; B65D 43/162; B65D 43/163; B65D 43/166; B65D 43/167; B65D 43/20; B65D 43/22; B65D 43/24; B65D 43/26; B65D 45/305; B65D 45/32; B65D 47/00; B65D 47/06; B65D 47/20; B65D 47/26; B65D 47/265; B65D 47/286; B65D 5/064; B65D 5/08; B65D 5/12; B65D 5/38; B65D 5/4204; B65D 5/4208; B65D 5/422; B65D 5/4225; B65D 5/4233; B65D 5/4258; B65D 5/4266; B65D 5/4279; B65D 5/5213; B65D 5/606; B65D 50/04; B65D 50/046; B65D 51/1644; B65D 51/18; B65D 51/24; B65D 51/242; B65D 51/26; B65D 51/28; B65D 53/00; B65D 53/02; B65D 55/00; B65D 55/02; B65D 55/14; B65D 55/16; B65D 61/00; B65D 63/10; B65D 63/1063; B65D 63/16; B65D 65/466; B65D 7/24; B65D 71/0096; B65D 73/0007; B65D 73/0014; B65D 73/0035; B65D 73/0092; B65D 75/522; B65D 75/566; B65D 75/58; B65D 77/042; B65D 77/061; B65D 77/30; B65D 81/02; B65D 81/05; B65D 81/052; B65D 81/07; B65D 81/09; B65D 81/107; B65D 81/18; B65D 81/24; B65D 81/245; B65D 81/26; B65D 81/261; B65D 81/263; B65D 81/266; B65D 81/34; B65D 81/36; B65D 81/365; B65D 81/3813; B65D 81/3823; B65D 81/3897; B65D 83/00; B65D 83/02; B65D 83/04; B65D 83/0409; B65D 83/08; B65D 83/0805; B65D 83/0835; B65D 83/0894; B65D 83/76; B65D 85/00; B65D 85/10; B65D 85/20; B65D 85/30; B65D 85/302; B65D 85/36; B65D 85/38; B65D 85/48; B65D 85/50; B65D 85/68; B65D 85/70; B65D 85/72; B65D 85/812; B65D 85/816; B65D 88/08; B65D 88/12; B65D 88/125; B65D 88/126; B65D 88/14; B65D 88/1668; B65D 88/22; B65D 88/34; B65D 88/522; B65D 88/54; B65D 88/546; B65D 88/62; B65D 88/68; B65D 90/00; B65D 90/008; B65D 90/021; B65D 90/06; B65D 90/10; B65D 90/12; B65D 90/325; B65D 90/48; B65D 90/54; B65D 90/582; B65D 90/587; B65D 90/66; B65D 1/0207; B65D 1/0215; B65D 1/32; B65D 1/34; B65D 1/40; B65D 1/42; B65D 11/02; B65D 11/04; B65D 13/02; B65D 19/0002; B65D 19/18; B65D 21/023; B65D 21/062; B65D 2203/00; B65D 2205/00; B65D 2207/00; B65D 2211/00; B65D 2213/02; B65D 23/02; B65D 23/0814; B65D 23/0821; B65D 23/0835; B65D 23/10; B65D 2301/20; B65D 2313/02; B65D 25/14; B65D 25/42; B65D 25/56; B65D 2543/00361; B65D 2543/00527; B65D 2565/384; B65D 2565/385; B65D 2565/387; B65D 2571/00018; B65D 2571/00024; B65D 2571/0003; B65D 2571/00141; B65D 2571/00574; B65D 2571/0066; B65D 2571/00728; B65D 2575/583; B65D 2575/586; B65D 2581/3421; B65D 2583/0422; B65D 2588/12; B65D 2588/162; B65D 2588/54; B65D 2588/645; B65D 2588/746; B65D 2590/0041; B65D 2590/005; B65D 2590/0066; B65D 2590/0083; B65D 2590/0091; B65D 2590/04; B65D 2590/043; B65D 2590/046; B65D 2590/54; B65D 2590/542; B65D 2590/547; B65D 2590/66; B65D 2590/664; B65D 29/00; B65D 29/02; B65D 3/04; B65D 31/02; B65D 31/04; B65D 31/10; B65D 31/142; B65D 31/16; B65D 33/00; B65D 33/004; B65D 33/01; B65D 33/02; B65D 33/06; B65D 33/065; B65D 33/08; B65D 33/1691; B65D 33/20; B65D 33/22; B65D 33/25; B65D 33/2533; B65D 33/30; B65D 35/04; B65D 35/10; B65D 35/24; B65D 37/00; B65D 39/00; B65D 43/00; B65D 43/0222; B65D 47/0809; B65D 47/32; B65D 5/00; B65D 5/563; B65D 5/725;

B65D 51/00; B65D 51/16; B65D 51/20; B65D 51/2807; B65D 65/38; B65D 65/40; B65D 65/42; B65D 65/46; B65D 71/08; B65D 71/36; B65D 75/00; B65D 75/008; B65D 75/20; B65D 75/22; B65D 75/28; B65D 75/30; B65D 75/366; B65D 75/52; B65D 75/525; B65D 75/54; B65D 75/563; B65D 75/5805; B65D 75/5811; B65D 75/5816; B65D 75/5855; B65D 75/5866; B65D 75/5872; B65D 75/5877; B65D 75/5883; B65D 77/00; B65D 77/0466; B65D 77/06; B65D 77/062; B65D 77/225; B65D 77/24; B65D 81/03; B65D 81/1075; B65D 81/2007; B65D 81/2023; B65D 81/2038; B65D 81/2069; B65D 81/2076; B65D 81/267; B65D 81/28; B65D 81/30; B65D 81/32; B65D 81/3233; B65D 81/3283; B65D 81/3453; B65D 83/0094; B65D 83/06; B65D 85/07; B65D 85/8043; B65D 88/00; B65D 88/005; B65D 88/02; B65D 88/022; B65D 88/025; B65D 88/06; B65D 88/10; B65D 88/121; B65D 88/123; B65D 88/127; B65D 88/128; B65D 88/129; B65D 88/16; B65D 88/1606; B65D 88/1612; B65D 88/1618; B65D 88/1625; B65D 88/1631; B65D 88/1637; B65D 88/1662; B65D 88/1681; B65D 88/1687; B65D 88/26; B65D 88/28; B65D 88/30; B65D 88/32; B65D 88/52; B65D 88/526; B65D 88/542; B65D 88/548; B65D 88/56; B65D 88/58; B65D 88/60; B65D 88/64; B65D 88/66; B65D 88/70; B65D 88/703; B65D 88/72; B65D 88/74; B65D 88/741; B65D 88/742; B65D 88/744; B65D 88/745; B65D 88/747; B65D 88/76; B65D 88/78; B65D 90/0013; B65D 90/0026; B65D 90/0033; B65D 90/004; B65D 90/0046; B65D 90/0053; B65D 90/006; B65D 90/0066; B65D 90/0093; B65D 90/02; B65D 90/022; B65D 90/023; B65D 90/024; B65D 90/027; B65D 90/028; B65D 90/029; B65D 90/04; B65D 90/041; B65D 90/043; B65D 90/046; B65D 90/047; B65D 90/048; B65D 90/08; B65D 90/14; B65D 90/18; B65D 90/20; B65D 90/205; B65D 90/22; B65D 90/24; B65D 90/32; B65D 90/34; B65D 90/36; B65D 90/38; B65D 90/46; B65D 90/545; B65D 90/585; B65D 90/60; B65D 90/623; B65D 90/626; E05F 11/04

USPC ..... 220/1.5, 1.6, 200, 202, 203.01, 203.04, 220/203.07, 203.09, 203.1, 203.27, 220/203.29, 210, 211, 212, 212.5, 213, 220/214, 216, 219, 220, 221, 222, 23.2, 220/23.4, 23.6, 23.8, 23.83, 23.86, 23.87, 220/23.88, 23.89, 23.91, 230, 231, 233, 220/234, 240, 241, 242, 251, 252, 253, 220/254.1, 254.2, 254.3, 254.4, 254.5, 220/254.6, 254.7, 254.8, 254.9, 255, 220/255.1, 256.1, 258.3, 258.4, 258.5, 220/259.1, 259.2, 259.3, 259.4, 259.5, 220/260, 262, 263, 264, 265, 266, 267, 220/268, 269, 270, 276, 277, 278, 281, 220/283, 284, 285, 287, 288, 290, 291, 220/293, 295, 296, 298, 3.2, 3.3, 3.5, 3.6, 220/3.7, 3.8, 3.9, 3.94, 300, 301, 302, 220/303, 304, 305, 314, 315, 316, 318, 220/319, 320, 322, 323, 324, 325, 326, 220/327, 328, 345.1, 345.2, 345.3, 345.4, 220/345.5, 345.6, 348, 350, 351, 359.2, 220/360, 361, 366.1, 367.1, 370, 372, 220/373, 375, 376, 377, 378, 379, 380, 220/4.01, 4.02, 4.21, 4.22, 4.23, 4.24, 220/4.26, 4.27, 4.28, 4.29, 4.32, 4.33, 220/4.34, 475, 476, 480, 481, 482, 484, 220/495.01, 495.02, 495.05, 495.06, 220/495.07, 495.08, 495.1, 495.11, 500, 220/501, 502, 503, 504, 507, 509, 513, 220/516, 520, 521, 522, 523, 524, 525, 220/526, 527, 528, 529, 530, 532, 533, 220/544, 553, 555, 560.01, 560.04, 220/560.05, 560.1, 560.12, 562, 565, 220/567.2, 569, 573.1, 573.4, 574, 576, 220/578, 582, 592.01, 592.02, 592.03, 220/592.16, 592.17, 592.2, 592.21, 220/592.25, 592.26, 592.27, 6, 601, 62, 220/625, 630, 631, 632, 648, 652, 655, 220/659, 660, 662, 665, 666, 668, 669, 220/675, 676, 690, 691, 694, 697, 7, 703, 220/705, 706, 708, 709, 711, 713, 714, 220/715, 717, 719, 720, 721, 724, 729, 220/730, 731, 735, 737, 739, 740, 744, 220/745, 752, 754, 756, 758, 759, 762, 220/763, 769, 770, 771, 772, 776, 780, 220/781, 782, 783, 784, 786, 787, 788, 220/789, 791, 792, 793, 795, 796, 799, 8, 220/801, 806, 810, 811, 812, 813, 814, 220/815, 816, 817, 819, 820, 821, 823, 220/824, 825, 826, 827, 828, 829, 830, 220/831, 832, 833, 834, 835, 836, 837, 220/838, 839, 840, 841, 843, 844, 845, 220/849, 86.1, 86.2, 87.1, 88.2, 89.1, 9.1, 220/9.2, 9.3, 9.4, 901, 903, 906, 908, 220/908.1, 909, 912, 913, 918, DIG. 10, 220/DIG. 11, DIG. 26, DIG. 33, DIG. 9, 220/203.08, DIG. 13, DIG. 30, FOR. 192; 49/168, 198, 262, 279, 345, 347, 357, 49/360, 362, 365, 367, 404, 463, 464, 49/465, 466, 506; 52/1, 100, 192, 193, 52/194, 195, 196, 197, 2.26, 208, 222, 52/236.2, 236.4, 245, 247, 249, 263, 29, 52/293.1, 295, 299, 4, 583.1, 608, 63, 52/651.07, 66, 699, 707, 708, 742.14, 52/745.01, 745.04, 745.07, 745.15, 52/745.17, 79.2, 79.3, 79.9, 81.2, 83, 836, 52/849, 88, 98, DIG. 13; 206/0.5, 0.6, 206/0.7, 204, 205, 210, 213, 213.1, 216, 206/219, 221, 222, 223, 226, 229, 230, 206/233, 277, 278.1, 287, 304, 305, 317, 206/343, 386, 403, 427, 438, 442, 45.26, 206/459.1, 459.5, 461, 494, 499, 504, 206/506, 508, 509, 511, 512, 517, 520, 206/521, 521.1, 522, 524, 524.1, 524.3, 206/524.4, 524.6, 524.7, 525, 526, 528, 206/531, 532, 539, 541, 542, 551, 554, 206/557, 562, 564, 576, 577, 581, 584, 206/585, 591, 592, 593, 594, 595, 596, 206/597, 598, 599, 6, 600, 701, 706, 707,

206/709, 713, 719, 723, 734, 819, 820,
206/823, 83.5, 85

See application file for complete search history.

(56) References Cited

U.S. PATENT DOCUMENTS

| | | | | | |
|---|---|---|---|---|---|
| 3,733,750 | A * | 5/1973 | Hege | B65D 90/34 | 52/192 |
| 4,208,839 | A * | 6/1980 | Candy, Sr. | B65D 90/10 | 49/357 |
| 4,267,936 | A * | 5/1981 | Pavlicek | B65D 90/10 | 49/404 |
| 4,327,522 | A * | 5/1982 | Meadows | B65D 90/10 | 49/357 |
| 4,625,888 | A * | 12/1986 | Thompson | B65D 90/623 | 49/404 |
| 4,744,183 | A * | 5/1988 | Kruger | B65D 90/623 | 220/264 |
| 4,747,244 | A * | 5/1988 | Christianson | B65D 90/10 | 220/264 |
| 5,218,784 | A * | 6/1993 | Pollock | E05F 11/04 | 52/192 |
| 5,839,597 | A * | 11/1998 | Marttila | B65D 90/10 | 220/264 |
| 8,196,362 | B1 * | 6/2012 | Ratts | E05F 11/12 | 52/192 |
| 10,161,176 | B1 * | 12/2018 | Schmidt | E05F 15/60 | |

FOREIGN PATENT DOCUMENTS

| | | | |
|---|---|---|---|
| JP | H07207853 | A | 8/1995 |
| JP | H09177227 | A | 7/1997 |
| KR | 20090121491 | A | 11/2009 |

* cited by examiner

STORAGE CONTAINER LID ASSEMBLY AND RELATED METHODS AND SYSTEMS

CROSS-REFERENCE TO RELATED APPLICATIONS

N/A

TECHNICAL FIELD

The present disclosure relates to commodity storage containers and lid assemblies for commodity storage containers.

BACKGROUND

Grain bins (i.e., grain storage containers) typically include bulk storage structures for dry commodities (e.g., corn, soybean, wheat, oats, barley, etc.). Grain bins typically include cylinders made of corrugated sheets or sheet metal with a coned metal roof that includes vents. The floors of grain bins typically have aeration systems to keep good air flow through the commodities and keep it at a good temperature and humidity level to prevent spoilage. At the top of each grain bin, a central opening is typically defined that can be interface with conveyors to receive grain.

BRIEF SUMMARY

Embodiments include a lid assembly for a storage container. The lid assembly may include a rail guide member configured to be mounted to a slanted roof of the storage container, the roof being slanted relative to a horizontal plane by a first angle, and a lid coupled to the rail guide member and configured to slide along the rail guide member between open and closed positions, where, when the lid is in an open position, an upper surface of the lid is oriented at a second angle relative to the horizontal plane, and where the second angle is at least substantially equal to the first angle.

The lid assembly may also include an attachment bracket coupled to the lid, and a cable coupled to the attachment bracket.

The attachment bracket may extend past an outer peripheral edge of the lid.

The attachment bracket may include a first member connected to a first lateral side of the lid and extending at a first acute angle relative to the upper surface of the lid and at least partially over the upper surface of the lid, a second member connected to a second, opposite lateral side of the lid and extending at a second acute angle relative to the upper surface of the lid and in a direction away from lid, where the first acute angle is smaller than the second acute angle.

The first member of the attachment bracket, the second member of the attachment bracket, and the upper surface of the lid may define a triangle.

The cable may be coupled to the attachment bracket at a portion of the attachment bracket extending past the outer per peripheral edge of the lid.

The lid may be rotatably coupled to the rail guide member via a coupling member.

Some embodiments include a lid assembly mounted to a roof of a storage container. The lid assembly may include a rail guide member mounted to the roof of the storage container and a lid rotatably coupled to the rail guide member and configured to slide along the rail guide member between open and closed positions, where, when the lid is in an open position, a center longitudinal axis of the rail guide member is at least substantially parallel to an upper surface of the lid.

The rail guide member may include a furring channel.

An upper surface of a web of the furring channel may be at least substantially parallel to the upper surface of the lid when the lid is in an open position.

An upper surface of a web of the furring channel may be at oriented at an acute angle relative to the upper surface of the lid when the lid is in a closed position.

The lid may be rotatably coupled to the rail via a coupling member.

One or more embodiments include a storage container system. The storage container may include a frustoconical roof defining a central opening and a lid assembly mounted to the roof of the storage container. The lid assembly may include a rail guide member mounted to the roof of the storage container and oriented such that a center longitudinal axis of the rail guide member has a same pitch as the roof and a lid rotatably coupled to the rail guide member and configured to slide along the rail guide member between open and closed positions over the opening, where, when the lid is in an open position, an upper surface of the lid has a same pitch as the roof.

The lid may be configured to rotate about a horizontal axis via a pivotal connection to the coupling member.

The coupling member may be slidably coupled to the rail guide member.

The lid assembly may also include an attachment bracket coupled to the lid and a cable coupled to the attachment bracket.

The attachment bracket may extend past an outer peripheral edge of the lid.

The cable may be coupled to the attachment bracket at a portion of the attachment bracket extending past the outer per peripheral edge of the lid.

The lid may be configured to rotate about a horizontal axis via a pivotal connection to the coupling member.

The coupling member may be slidably coupled to the rail.

Other technical features may be readily apparent to one skilled in the art from the following figures, descriptions, and claims.

Within the scope of this application, it should be understood that the various aspects, embodiments, examples and alternatives set out herein, and individual features thereof may be taken independently or in any possible and compatible combination. Where features are described with reference to a single aspect or embodiment, it should be understood that such features are applicable to all aspects and embodiments unless otherwise stated or where such features are incompatible.

BRIEF DESCRIPTION OF THE DRAWINGS

While the specification concludes with claims particularly pointing out and distinctly claiming what are regarded as embodiments of the present disclosure, various features and advantages may be more readily ascertained from the following description of example embodiments when read in conjunction with the accompanying drawings, in which:

FIG. 5A and FIG. 4AB show various additional views of cable assembly of the lid assembly.

DETAILED DESCRIPTION

Figure 1:
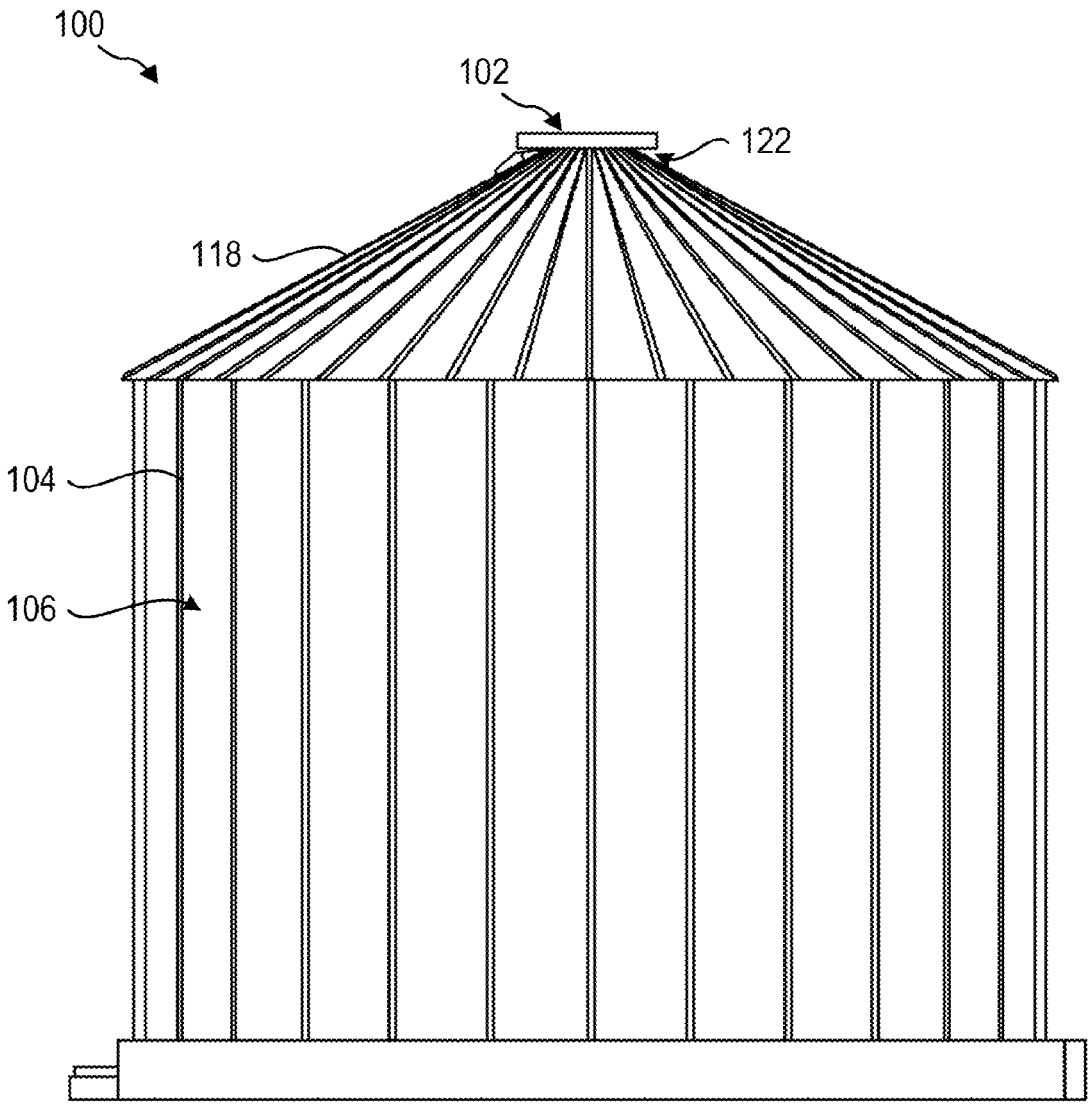
FIG. 1 shows a schematic view of a storage container and lid assembly according to one or more embodiments of the disclosure.

Illustrations presented herein are not meant to be actual views of any particular storage container or lid assembly, component, or system, but are merely idealized representations that are employed to describe embodiments of the disclosure. Additionally, elements common between figures may retain the same numerical designation for convenience and clarity.

The following description provides specific details of embodiments. However, a person of ordinary skill in the art will understand that the embodiments of the disclosure may be practiced without employing many such specific details. Indeed, the embodiments of the disclosure may be practiced in conjunction with conventional techniques employed in the industry. In addition, the description provided below does not include all the elements that form a complete structure or assembly. Only those process acts and structures necessary to understand the embodiments of the disclosure are described in detail below. Additional conventional acts and structures may be used. The drawings accompanying the application are for illustrative purposes only, and are thus not drawn to scale.

As used herein, the terms "comprising," "including," "containing," "characterized by," and grammatical equivalents thereof are inclusive or open-ended terms that do not exclude additional, unrecited elements or method steps, but also include the more restrictive terms "consisting of" and "consisting essentially of" and grammatical equivalents thereof.

As used herein, the singular forms following "a," "an," and "the" are intended to include the plural forms as well, unless the context clearly indicates otherwise.

As used herein, the term "may" with respect to a material, structure, feature, or method act indicates that such is contemplated for use in implementation of an embodiment of the disclosure, and such term is used in preference to the more restrictive term "is" so as to avoid any implication that other compatible materials, structures, features, and methods usable in combination therewith should or must be excluded.

As used herein, the term "configured" refers to a size, shape, material composition, and arrangement of one or more of at least one structure and at least one apparatus facilitating operation of one or more of the structure and the apparatus in a predetermined way.

As used herein, the term "substantially" in reference to a given parameter, property, or condition means and includes to a degree that one skilled in the art would understand that the given parameter, property, or condition is met with a small degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" used in reference to a given parameter is inclusive of the stated value and has the meaning dictated by the context (e.g., it includes the degree of error associated with measurement of the given parameter, as well as variations resulting from manufacturing tolerances, etc.).

As used herein, the term "and/or" includes any and all combinations of one or more of the associated listed items.

FIG. 1 shows a schematic view of a storage container 100 (e.g., a grain storage bin) according to one or more embodiments of the present disclosure. The storage container 100 may include a main body 104 and a lid assembly 102. The main body 104 may include a bottom housing 106 and a roof 118. The bottom housing 106 may be cylindrical and may be sized and shape to house (e.g., contain) a commodity, and the roof 118 may include a frusto-conical shaped roof defining a central opening 122. The lid assembly 102 may be at least partially disposed over the central opening 122 and, as is described in greater detail, may be configured to enable an operator to easily place and remove a lid over the central opening 122.

Figure 2:
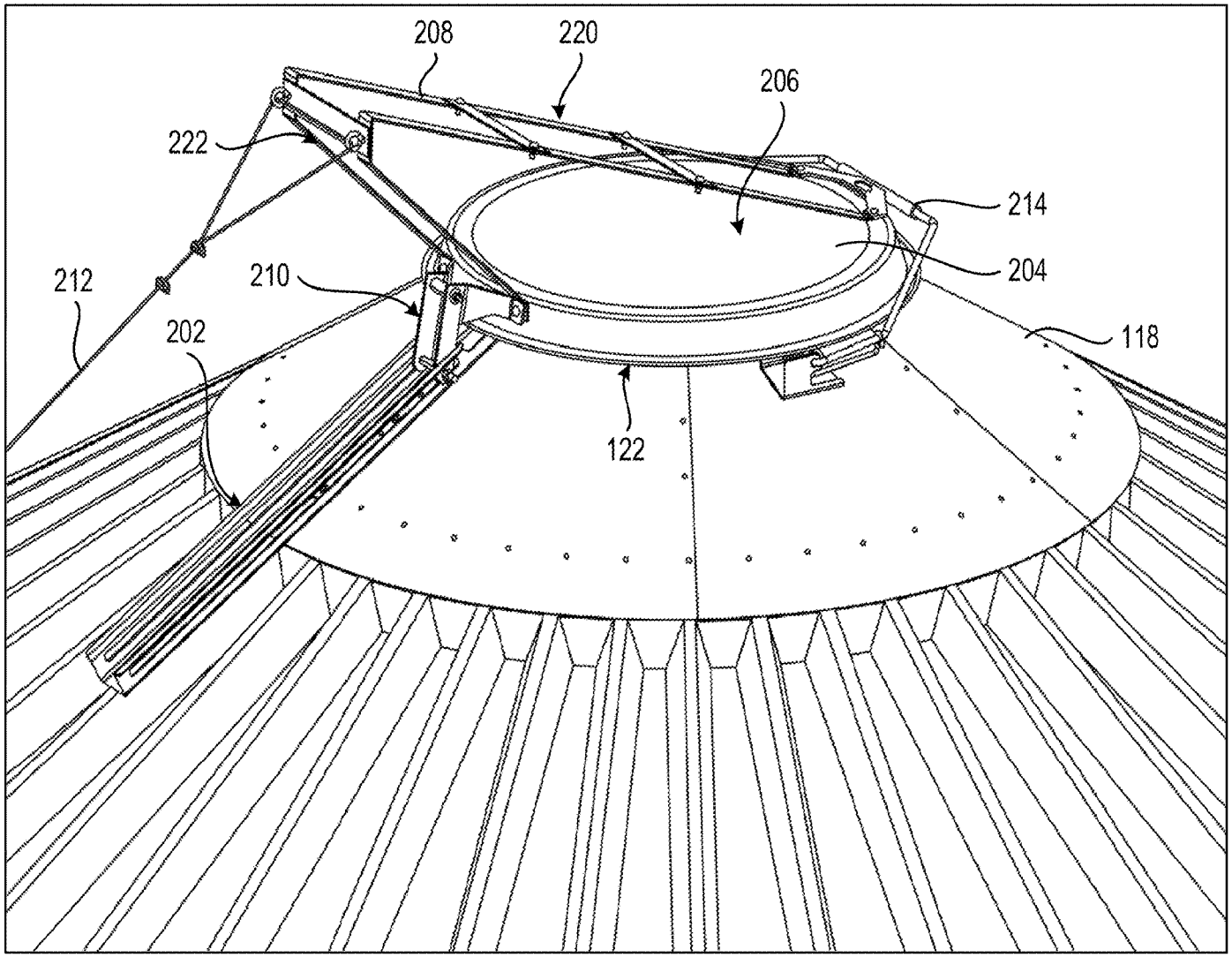
FIG. 2 shows a perspective view of a lid assembly according to one or more embodiments of the disclosure.

FIG. 2 is a partial perspective view of the storage container 100 and lid assembly 102 of FIG. 1. In some embodiments, the lid assembly 102 may include a rail guide member 202, a cable 212, an attachment bracket 208, a lid 204, a coupling member 210, and a pivot lever assembly 214.

The rail guide member 202 may be mounted to the roof 118 of the storage container 100. The lid 204 may be cylindrical in shape and may be coupled to the rail guide member 202 via a coupling member 210. The coupling member 210 may be fixedly attached to the lid 204 and may be rotatably and slidably coupled to the rail guide member 202. For instance, the coupling member 210 may be rotatably coupled to the rail guide member 202 via a pin such that the coupling member 210 may rotate (e.g., pivot) about a horizontal axis relative to the rail guide member 202. Additionally, the coupling member 210 may be slidably coupled to the rail guide member 202 via a pin and slot connection. For instance, the pin, about which the coupling member 210 can rotate, may also extend through one or more slots (e.g., slot apertures or slot grooves) defined in the rail guide member 202 along a longitudinal length of the rail guide member 202, and the coupling member 210 may be slidable along the one or more slots. The lid 204 may be configured to slide along the rail guide member 202 via the coupling member 210 and between open and closed positions. In one or more embodiments, the rail guide member 202 may include furring channel (e.g., hat channel) with the one or more slots formed in sidewalls of the furring channel.

In some embodiments, the roof 118 may be slanted (e.g., angled) relative to a horizontal plane by a first angle ($\alpha$), and when the lid 204 is in an open position (discussed below), the upper surface 206 of the lid 204 may be oriented at a second angle ($\beta$) relative to the horizontal plane. In one or more embodiments, the first angle ($\alpha$) may be at least substantially equal to the second angle ($\beta$). Put another way, when the lid 204 is in an open position, the upper surface 206 of the lid 204 may have substantially a same pitch as the roof 118 of the storage container. Moreover, when the lid 204 is in an open position, a center longitudinal axis of the rail guide member 202 may be at least substantially parallel to the upper surface 206 (e.g., upper planar surface) of the lid 204, and when the lid 204 is in a closed position, the center longitudinal axis of the rail guide member 202 may be oriented at an obtuse angle relative to the upper surface 206 of the lid 204. As a result, when the lid 204 is in an open position, the upper surface 206 of the lid 204 may be at least substantially parallel to an upper surface of a web of the furring channel of the rail guide member 202.

Figure 3A:
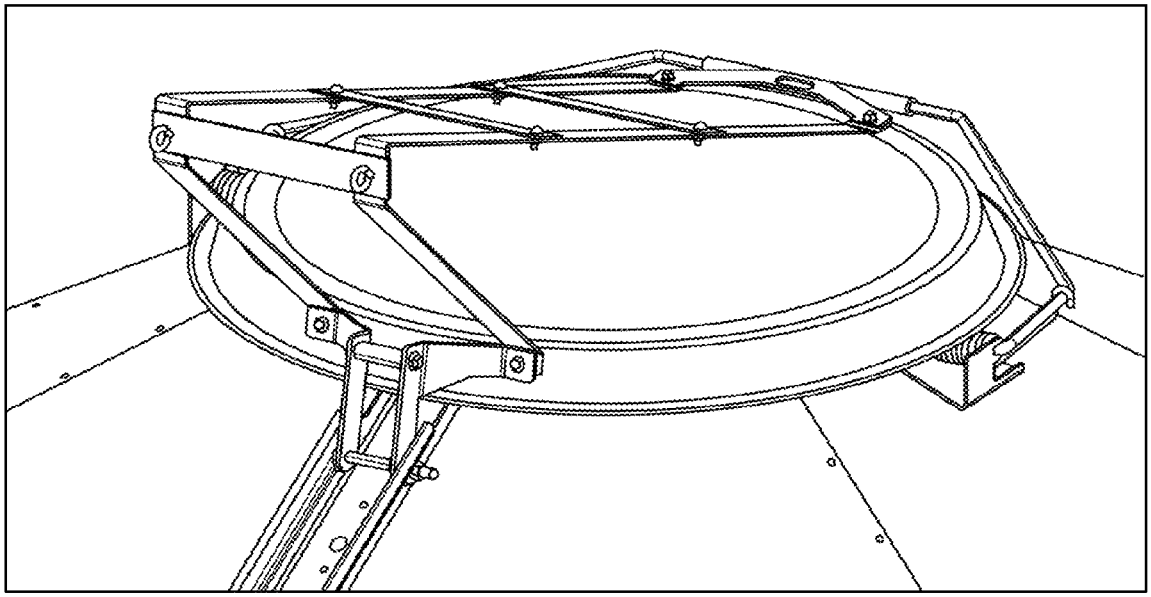
FIG. 3A and FIG. 3B show additional views of the lid assembly.
Figure 3B:
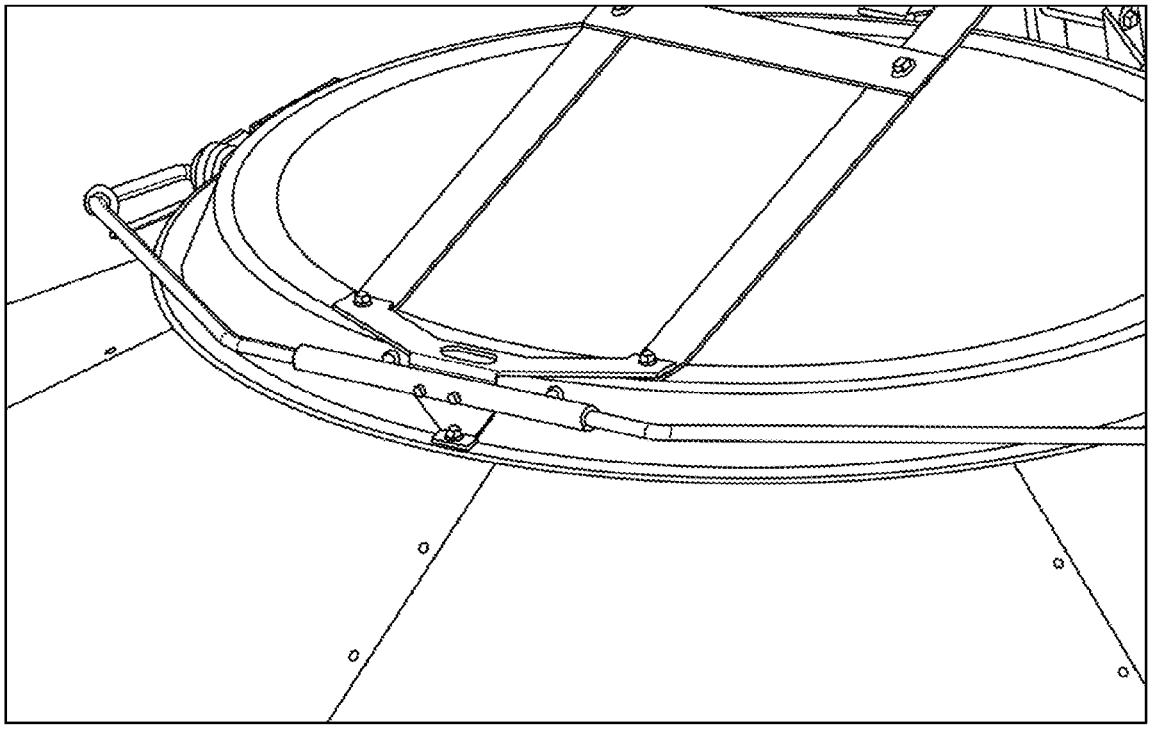

The attachment bracket 208 may be attached to the lid 204, and the cable 212 may be coupled to the attachment bracket 208. FIG. 3A and FIG. 3B show perspective views of the lid assembly 102 from opposing lateral sides of the lid 204. In particular, FIG. 3B shows a perspective view of the lid assembly 102 from a first lateral side of the lid 204, and FIG. 3A shows a perspective view of the lid assembly 102 from a second, opposite lateral side of the lid 204. Referring to FIG. 1 through FIG. 3B together, in some embodiments, the attachment bracket 208 may include a first member 220 connected to a first lateral side of the lid 204 and extending at a first acute angle relative to the upper surface 206 of the lid 204 and extending at least partially over (e.g., above) the upper surface 206 of the lid 204. Additionally, the attachment bracket 208 may include a second member 222 connected to a second, opposite lateral side of the lid 204 and extending at a second acute angle relative to the upper surface 206 of the lid 204 and in a direction away from lid 204. For instance, the attachment bracket 208 may extend, in a horizontal direction, past an outer peripheral edge of the lid 204. In some embodiments, the first acute angle may smaller than the second acute angle. Furthermore, in one or more embodiments, the first member 220 of the attachment bracket 208, the second member 222 of the attachment bracket 208, and the upper surface 206 of the lid 204 may define a general triangle shape within a vertical plane.

Figure 4A:
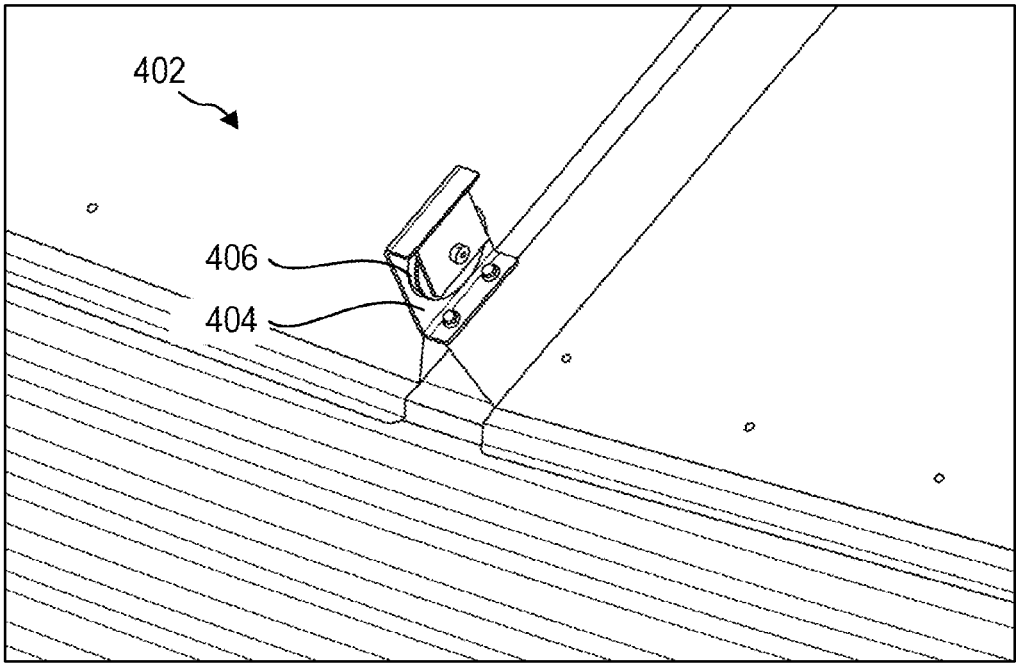
FIG. 4A and FIG. 4AB show various views of cable assembly of the lid assembly.
Figure 4B:
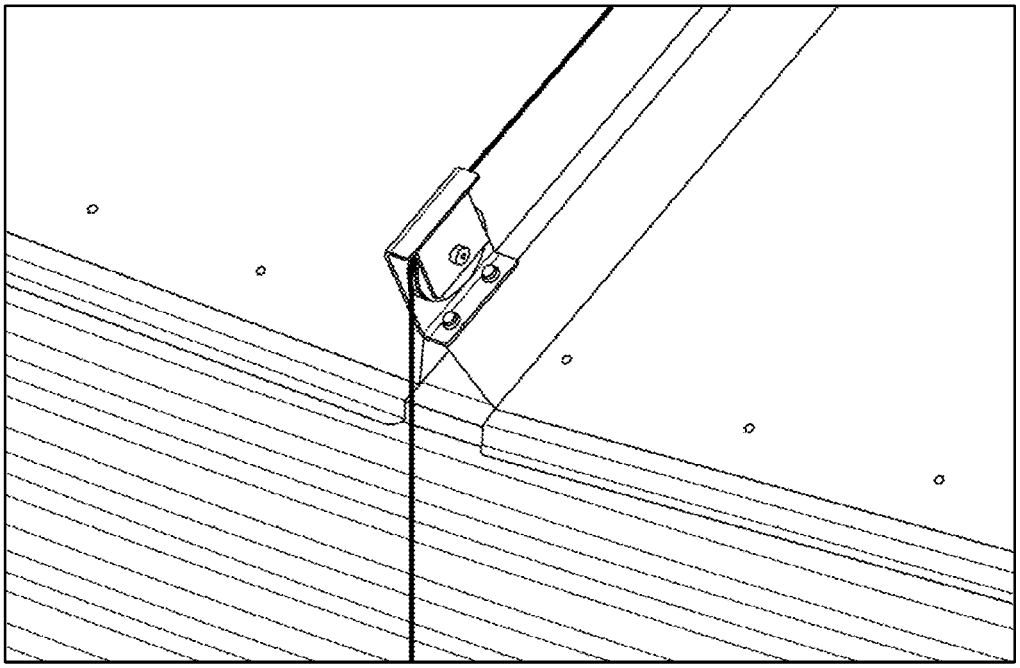
Figure 5A:
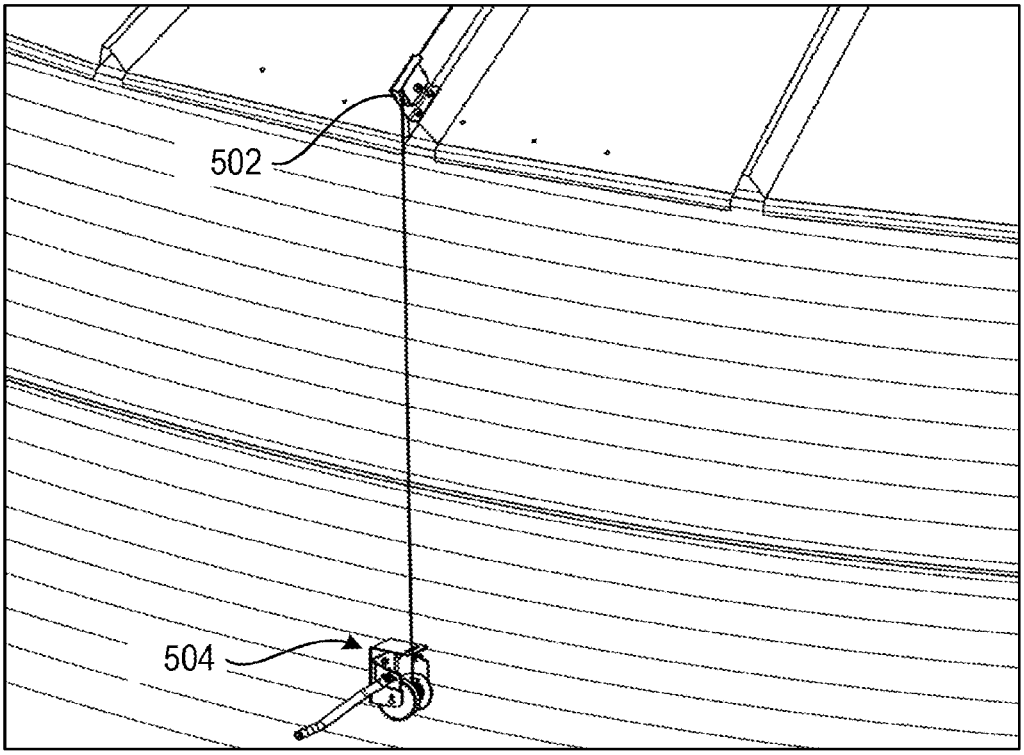
Figure 5B:
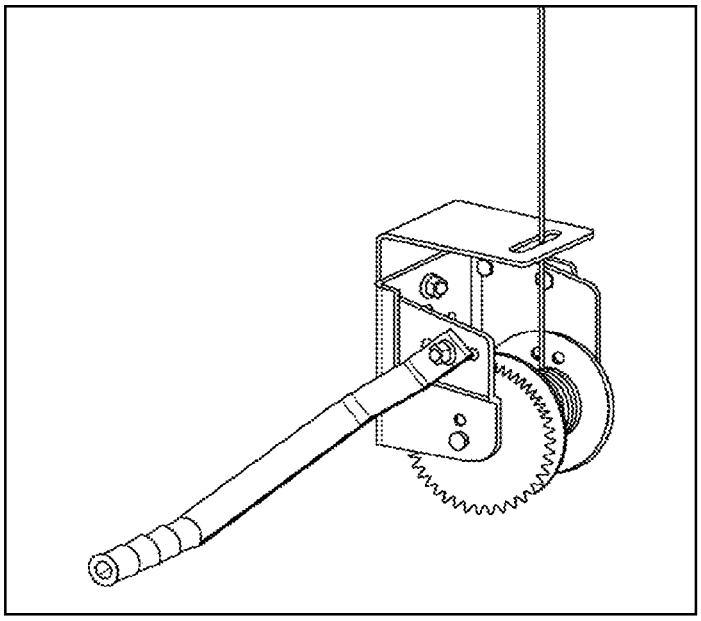

As noted above, the cable 212 may be coupled to the attachment bracket 208. The cable 212 may be utilized to move the lid 204 between open and closed positions and may form a portion of a cable assembly. FIG. 4A shows a partial, perspective view of a portion of a cable assembly 402 according to one or more embodiments of the present disclosure. FIG. 4B shows another partial, perspective view of a portion of the cable assembly 402 of FIG. 4B. FIG. 5A and FIG. 5B show yet additional perspective views of portions of the cable assembly 402 of FIG. 4B.

Referring to FIG. 1 through FIG. 5B together, the cable assembly 402 may include the cable 212, an eave pulley assembly 502, and a winch assembly 504. The eave pulley assembly 502 may be mounted to an edge (e.g., an eave) of the roof 118 of the storage container 100 and may include a mounting bracket 404 and pulley 406. The winch assembly 504 may be mounted to an external surface of the bottom housing 106 of the storage container 100 and may include a typical winch system. For instance, the winch assembly 504 may include a rotatable spool about which the cable 212 may be wound and a manual handle or motor that can be utilized to rotate the rotatable spool.

The cable 212 may be attached to the attachment bracket 208, extend from the attachment bracket 208 to the eave pulley assembly 502, engage the pulley 406 of the eave pulley assembly 502, extend down a side of the bottom housing 106, and be coupled to the winch assembly 504. In some embodiments, the cable 212 may be attached to the attachment bracket 208 at a portion of the attachment bracket 208 extending past the outer per peripheral edge of the lid 204 in a horizontal direction. Operation of the lid assembly 102 is described in greater detail below.

Figure 6A:
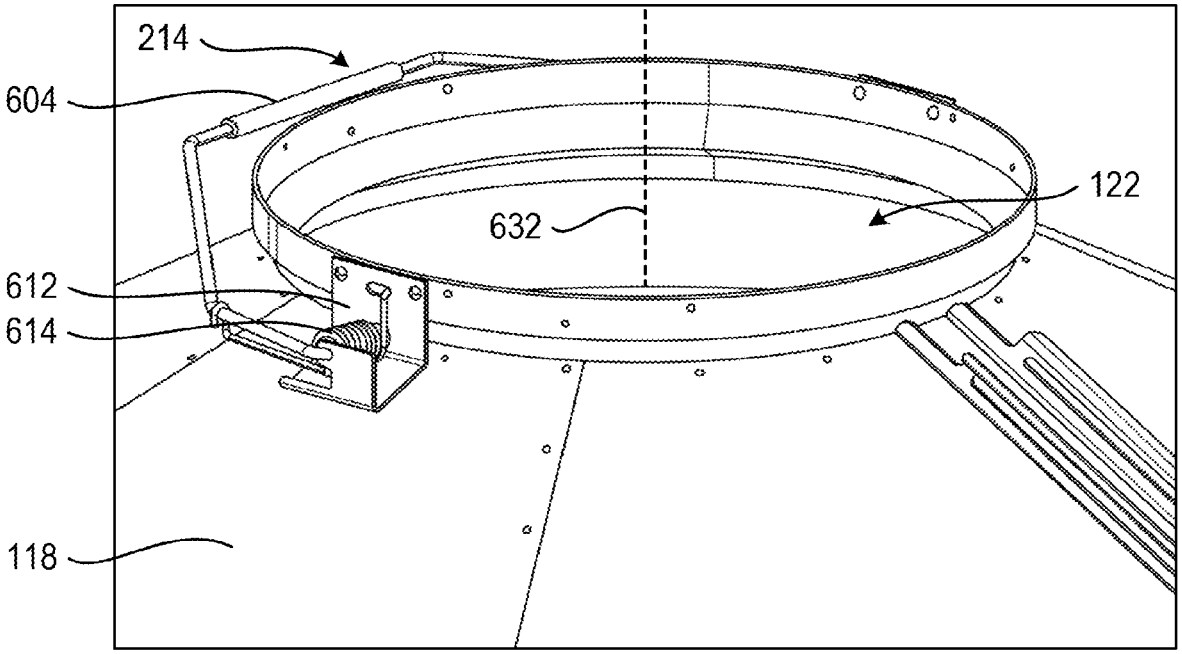
FIG. 6A and FIG. 6B show various views of a pivot lever assembly of the lid assembly.
Figure 6B:
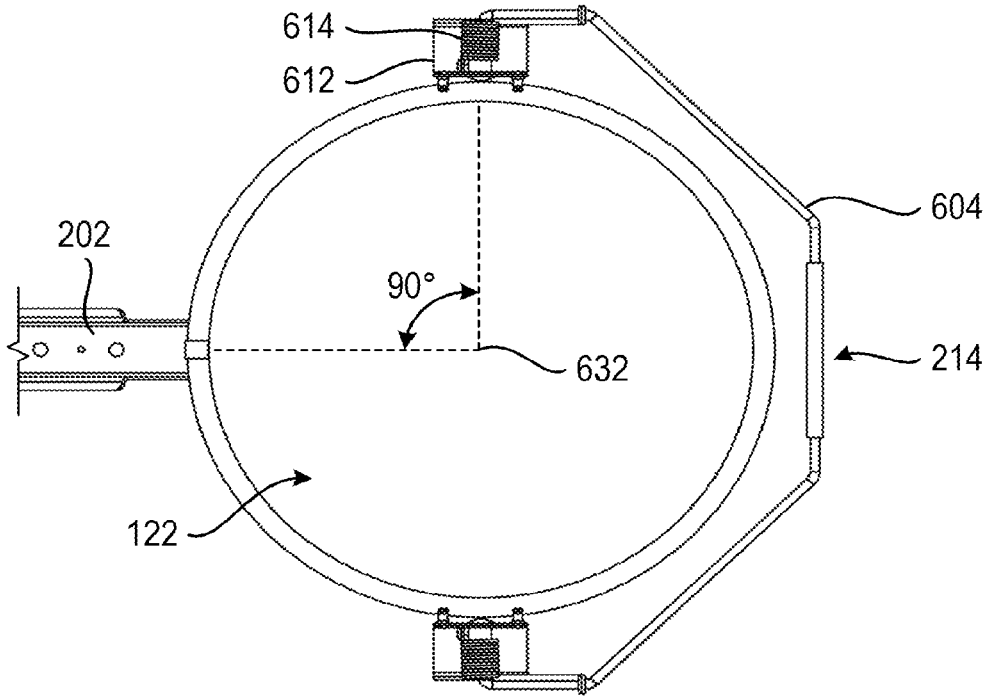

FIG. 6A is a perspective view of the pivot lever assembly 214 of the lid assembly 102 according to one or more embodiments of the present disclosure. FIG. 6B is a top view of the pivot lever assembly 214 of FIG. 6A. Referring to FIG. 1 through FIG. 6B together, the pivot lever assembly 214 may include a lever arm 604, at least one biasing member 614, and at least one mounting bracket 612.

In some embodiments, the lever arm 604 may be rotatable coupled to the lid 204 such that the level lever arm 604 is rotatable about a horizontal axis and may be coupled to the roof 118 of the storage container 100 on opposing sides of the central opening 122 via the at least one mounting bracket 404 and the at least one biasing member 614. For example, in some embodiments, the at least one mounting bracket 612 may include two mounting brackets 612 mounted to the roof 118 on opposing sides of the central opening 122, and the lever arm 604 may be rotatably coupled to the mounting brackets 612 with the at least one biasing member 614 engaging the lever arm 604 and the mounting brackets 404. In some embodiments, the at least one biasing member 614 may bias a rotation of the lever arm 604 relative to the mounting brackets 612 (e.g, about a horizontal axis intersecting a vertical axis 632 extending through a center point of the central opening 122) toward a side of the central opening 122 opposite the rail guide member 202 mounted to the roof of the storage container 100. Furthermore, because the lever arm 604 is biased toward a side of the central opening 122 opposite the rail guide member 202, the pivot lever assembly 214 may bias the lid 204 toward or to a closed position.

In some embodiments, the biasing member 614 may include a coil spring. In other embodiments, the biasing member 614 can include any conventional biasing mechanism for applying a torque to an object (e.g., cause the object to rotate about an axis).

In one or more embodiments, the lever arm 604 may include a generally U-shaped arm such that the level lever arm 604 can engage two mounting brackets 404 on opposing sides of the central opening 122.

Referring to FIG. 1 through FIG. 6B, during operation of the lid assembly 102 and to move the lid 204 from a closed position to an open position, the winch assembly 504 may be actuated (e.g., manually actuated or actuated by a motor) to cause the rotatable spool to rotate and wind the cable 212 about the rotatable spool of the winch assembly 504. Causing the cable 212 to wind about the rotatable spool of the winch assembly 504 causes the cable 212 to pull on the lever arm 604 and causes the lever arm 604 to pivot relative to the mounting brackets 612 of the pivot lever assembly 214 and rotate about a horizontal axis intersecting the vertical axis 632 extending through a center point of the central opening 122. Because the lever arm 604 is rotatably coupled to lateral side the lid 204, causing the lever arm 604 to pivot relative to the mounting brackets 612 and rotate about a horizontal axis intersecting the vertical axis 632 causes the lateral side of the lid 204 to lift with the lever arm 604 in an arcuate direction, and because the lid 204 is slidably and rotatably coupled to the rail guide member 202 on an opposing lateral side of the lid 204, causing the lever arm 604 to pivot relative to the mounting brackets 612 and rotate about a horizontal axis intersecting the vertical axis 632 causes the opposing lateral side of the lid 204 to rotate relative to the rail guide member 202 and begin to slide down the rail guide member 202.

Continuing to actuate the winch assembly 504 will eventually cause the lateral side of the lid 204 coupled to the lever arm 604 and the lever arm 604 to approximate the rail guide member 202 with the upper surface 206 of the lid 204 being at least substantially parallel to a center longitudinal axis of the rail guide member 202 and the central opening 122 of the storage container 100 being at least substantially entirely exposed. In other words, continuing to actuate the winch assembly 504 will eventually cause lid 204 to move into an open position from a closed position.

Conversely, to move the lid from the open position to a closed position, the winch assembly 504 can be released. In other words, the winch assembly 504 can be actuated to permit the rotatable spool to rotate freely. Once the winch assembly 504 is released, the biasing member 614 may cause the lever arm 604 to pivot relative to the mounting brackets 612 of the pivot lever assembly 214 and rotate about the horizontal axis intersecting the vertical axis 632 extending through a center point of the central opening 122 in an opposite direction relative to opening the lid 204.

Because the lever arm 604 is rotatably coupled to lateral side the lid 204, causing the lever arm 604 to pivot relative to the mounting brackets 612 and rotate about a horizontal axis intersecting the vertical axis 632 in the opposite direction causes the lateral side of the lid 204 to lift with the lever arm 604 in an opposite arcuate direction, and because the lid 204 is slidably and rotatably coupled to the rail guide member 202 on an opposing lateral side of the lid 204, causing the lever arm 604 to pivot relative to the mounting brackets 612 and rotate about a horizontal axis intersecting the vertical axis 632 in the opposite direction causes the opposing lateral side of the lid 204 to rotate relative to the rail guide member 202 and begin to slide up the rail guide member 202.

With a released winch assembly 504, the pivot lever assembly 214 will eventually cause the lateral side of the lid 204 coupled to the lever arm 604 and the lever arm 604 to approximate a side of central opening 122 opposite the rail guide member 202 with the upper surface 206 of the lid 204 being at least substantially parallel to a horizontal plane and the central opening 122 of the storage container 100 being at least substantially entirely covered. In other words, without opposing forces and without interference, the pivot lever assembly 214 will eventually cause lid 204 to move into a closed position from the open position.

All references cited herein are incorporated herein in their entireties. If there is a conflict between definitions herein and in an incorporated reference, the definition herein shall control.

The embodiments of the disclosure described above and illustrated in the accompanying drawings do not limit the scope of the disclosure, which is encompassed by the scope of the appended claims and their legal equivalents. Any equivalent embodiments are within the scope of this disclosure. Indeed, various modifications of the disclosure, in addition to those shown and described herein, such as alternate useful combinations of the elements described, will become apparent to those skilled in the art from the description. Such modifications and embodiments also fall within the scope of the appended claims and equivalents.

What is claimed is:

1. A lid assembly for a storage container, comprising:

a rail guide member configured to be mounted to a slanted roof of the storage container, the roof being slanted relative to a horizontal plane by a first angle;

a lid coupled to the rail guide member and configured to slide along the rail guide member between open and closed positions;

an attachment bracket coupled to the lid, the attachment bracket comprising:

a first member connected to a first lateral side of the lid and extending at a first acute angle relative to the upper surface of the lid and at least partially over the upper surface of the lid; and a second member connected to a second, opposite lateral side of the lid and extending at a second acute angle relative to the upper surface of the lid and in a direction laterally away from lid, wherein the first acute angle is smaller than the second acute angle, wherein:

when the lid is in an open position, an upper surface is oriented at a second angle relative to the horizontal plane; and the second angle is at least substantially equal to the first angle.

2. The lid assembly of claim 1, further comprising a cable coupled to the attachment bracket.

3. The lid assembly of claim 1, wherein the attachment bracket extends past an outer peripheral edge of the lid.

4. The lid assembly of claim 3, wherein the cable is coupled to the attachment bracket at a portion of the attachment bracket extending past the outer peripheral edge of the lid.

5. The lid assembly of claim 1, further comprising a pivot lever assembly coupled to first member of the attachment bracket.

6. The lid assembly of claim 1, wherein the lid is rotatably coupled to the rail guide member via a coupling member, the coupling member connected to each of the rail guide member and the second member of the attachment bracket.

7. The lid assembly of claim 6, wherein the lid is configured to rotate about a horizontal axis via a pivotal connection to the coupling member.

8. The lid assembly of claim 6, wherein the coupling member is slidably coupled to the rail guide member.

9. The lid assembly of claim 1, wherein the first member of the attachment bracket, the second member of the attachment bracket, and the upper surface of the lid define a triangle.

10. A lid assembly mounted to a roof of a storage container, comprising:

a rail guide member mounted to the roof of the storage container;

a lid rotatably coupled to the rail guide member and configured to slide along the rail guide member between open and closed positions, wherein when the lid is in an open position, a center longitudinal axis of the rail guide member is at least substantially parallel to an upper surface of the lid;

an attachment bracket coupled to the lid; and a coupling member coupled to the attachment bracket and slidably attached to the rail guide member.

11. The lid assembly of claim 10, wherein the rail guide member comprises a furring channel.

12. The lid assembly of claim 11, wherein an upper surface of a web of the furring channel is at least substantially parallel to the upper surface of the lid when the lid is in an open position.

13. The lid assembly of claim 11, wherein an upper surface of a web of the furring channel is oriented at an acute angle relative to the upper surface of the lid when the lid is in a closed position.

14. The lid assembly of claim 10, further comprising a cable coupled to the attachment bracket.

15. The lid assembly of claim 10, wherein the attachment bracket extends past an outer peripheral edge of the lid.

16. The lid assembly of claim 15, wherein the cable is coupled to the attachment bracket at a portion of the attachment bracket extending past the outer peripheral edge of the lid.

17. The lid assembly of claim 10, wherein the lid is rotatably coupled to the rail via the coupling member, wherein the attachment bracket comprises:

a first member connected to a first lateral side of the lid and extending at a first acute angle relative to the upper surface of the lid and at least partially over the upper surface of the lid; and a second member connected to a second, opposite lateral side of the lid and extending at a second acute angle relative to the upper surface of the lid and in a direction laterally away from lid, wherein the first acute angle is smaller than the second acute angle.

18. The lid assembly of claim 17, wherein the lid is configured to rotate about a horizontal axis via a pivotal connection to the coupling member.

19. The lid assembly of claim 17, wherein:

the first member of the attachment bracket is coupled to a pivot lever assembly on a lateral side of the lid opposite the coupling member; and a cable is coupled to the attachment bracket at an intersection of the first member and the second member.

20. A storage container system, comprising:

a storage container having a frustoconical roof defining a central opening; and a lid assembly mounted to the roof of the storage container, the lid assembly comprising:

a rail guide member mounted to the roof of the storage container and oriented such that a center longitudinal axis of the rail guide member has a same pitch as the roof;

a lid rotatably coupled to the rail guide member and configured to slide along the rail guide member between open and closed positions over the opening; and an attachment bracket coupled to the lid, the attachment bracket comprising:

a first member connected to a first lateral side of the lid and extending at a first acute angle relative to the upper surface of the lid and at least partially over the upper surface of the lid; and a second member connected to a second, opposite lateral side of the lid and extending at a second acute angle relative to the upper surface of the lid and in a direction laterally away from lid, wherein the first acute angle is smaller than the second acute angle, wherein when the lid is in an open position, an upper surface of the lid has a same pitch as the roof.

* * * * *